United States Patent [19]

Anka et al.

[11] 4,124,416

[45] Nov. 7, 1978

[54] PROCESS FOR THE HEAT TREATMENT OF COILS OF METALLIC STRIP, PREFERABLY OF ALUMINUM AND ALUMINUM ALLOYS

[75] Inventors: Mihaly Anka; Peter Lukacs; Dezso Gallo, all of Budapest; Jozsef Szabics; Geza Szalay, both of Székesfehérvar, all of Hungary

[73] Assignees: Aluminiumipari Tervezö és Kutató Intézet/ALUTERV-FKI, Budapest; Székesfehérvari Könnyüfemmü, Székesfehérvar; Budapesti Müszaki Egyetem, Budapest, all of Hungary

[21] Appl. No.: 788,792

[22] Filed: Apr. 19, 1977

[30] Foreign Application Priority Data

Apr. 27, 1976 [HU] Hungary ..... FE 969

[51] Int. Cl.[2] ..... C22F 1/04

[52] U.S. Cl. ..... 148/13; 148/150; 148/154; 148/155; 219/162

[58] Field of Search ..... 148/13, 134, 156, 154, 148/155, 150; 219/162

[56] References Cited

U.S. PATENT DOCUMENTS

| | | | |
|---|---|---|---|
| 3,294,598 | 12/1966 | Norris | 148/134 |
| 3,746,582 | 7/1973 | Gentry | 148/13 |

*Primary Examiner*—R. Dean

*Attorney, Agent, or Firm*—Karl F. Ross

[57] ABSTRACT

A process for the heat treatment of coils of aluminum and aluminum alloys in which lubricants applied to the surfaces of the metal strip, the usual oxide layer and a spacing between turns formed during coiling permit the application of a voltage across the coil between the ends of the strip of 0.01 to 0.25 volts per turn and a current intensity of 1,000 to 10,000 amperes, preferably 5,000 amperes, to heat the coil to 750° C. The coil is thereupon cooled.

2 Claims, 1 Drawing Figure

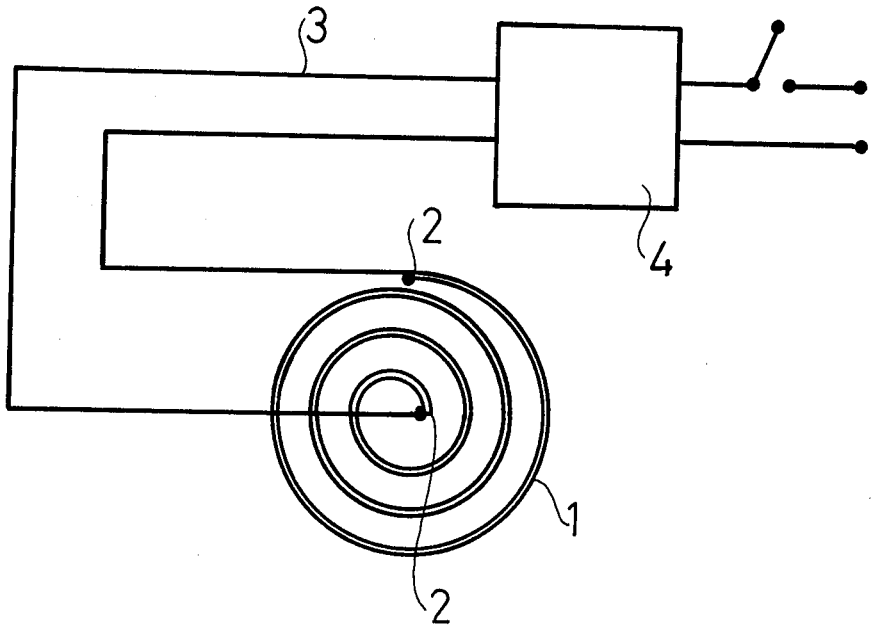
3
2
4
1
2

PROCESS FOR THE HEAT TREATMENT OF COILS OF METALLIC STRIP, PREFERABLY OF ALUMINUM AND ALUMINUM ALLOYS

FIELD OF THE INVENTION

The invention relates to a process and apparatus for the electrical heat treatment of plate, strip, and foil coils of different thicknesses and widths, made of metal, preferably of aluminum and aluminum alloys.

BACKGROUND OF THE INVENTION

In the metal industry several semi-products in various widths and thicknesses are produced by using different processes (e.g., hot and cold rolling, casting rolling etc.), these products being processed in the form of coils. Before and during processing, the coils are often subjected to heat treatment. The objects of heat treatment can be different, depending on the material qualities of the semi-product and on requirements relating to ultimate use and include annealing, tempering, stabilizing (stress-relieving), broaching etc.

Traditionally, heat treatment is performed in annealing furnaces. Three main processes are known. In the best-known process, the material charged into the furnace is subjected to heat treatment in a stationary state, i.e. it is not moved during the process. The second group of processes, use an arrangement in which coils move from one end of the relatively long furnace to the other end continuously or intermittently. In processes of the third type, the semi-product; in coils is continuously uncoiled. The common characteristic of the three types of processes lies in that heat treatment takes place by means of a heat carrier (air, gas, fluidized medium etc.).

The drawbacks of the traditional heat treating processes are well known. The construction and operation costs are rather high. The spatial requirements are also considerable. Due to indirect dissipation heat transfer, the degree of utilization of thermal energy is low and the duration of heat treatment is long. A further problem lies in the inhomogeneity of mechanical properties of the material subjected to heat treatment and the possibility of surfacial damage.

Heat treating processes are also known, in course of which the semi-product in a coil form is submitted to a heat treatment during rewinding in such a manner that over a given section electrical current is passed through the material, as described in the Italian Pat. No. 679,042 and in the British Pat. No. 1,200,089. Theoretically, with respect to the energy relationships, these processes are considered as advantageous, but owing to difficulties accompanying current input and due to complexity of control and possible damage to the material treated, the processes described above have not come in a general use in industry.

When strap coils are obtained from the strip mill, value of the insulation resistance to be measured between the single metal layers lying above each other, amounts to a considerable value. It has been found that insulation resistance can be considered as a product of the common insulating properties of the lubricant applied in course of rolling, of the oxide formed on the surface and the air gap, produced in course of coiling; as a consequence, in strap coils, as in roll-type foil condensers — between the metal layers of the single turns an insulating layer is formed. In case if to the ends of said coil an electrical supply unit is connected, at a given voltage electrical current can be passed through the coil without producing a breakdown or short-circuit between the turn-to-turn insulations. The value of the so-called turn-voltage between the single turns represents a function of the resistance of the insulating layer.

If in dependence of the insulation resistance of the insulating layer, direct or alternating current with a low turn-voltage (e.g., 0.2 V) and a high current intensity (e.g. 1000 A) is led through the coil, the coil is heated by the heat generated by the current. Taking into consideration that the electrical resistance of the coils is relatively low, even with a low supply-voltage a heating current of high intensity can be led through the coil.

Between the heating capacity generated and the electrical resistance of the strap there is a linear relation and between the heating capacity and the intensity of the current the relation is quadratic; as a consequence, besides high current intensities, relatively short heat treating duration (e.g. 1–60 minutes) can be achieved.

OBJECT OF THE INVENTION

The object of our invention is to eliminate the drawbacks arising from known heat-treating processes and to provide a process and apparatus which are suitable for the low-cost heat treatment of coil-formed semi-products.

SUMMARY OF THE INVENTION

In accordance with the invention the process can be characterized in that to the strap coils are subjected to heat treatment by electrodes which are connected to the coil; by means of these electrodes direct or alternating current is passed through the coils. The voltage applied (0.01–0.25 V/turn); is determined by the collective insulation resistance of the lubricant, the oxide layer and the air gap between the single turns. The intensity of the current is 1000–10,000 A; after having heated the strap coil to 150°–800° C, and after a certain holding time the coil is cooled by natural or artificial cooling.

An advantageous method of performance of the process according to the invention can be characterized in that in dependence upon the electrical resistance during heat treatment, the intensity of the direct or alternating current is altered.

The apparatus for performing the process according to the invention can comprise means for connecting the strap to the electrical network by electrodes and a regulator. Between the surfaces of the coil individual turns an air gap is formed.

In a preferred mode of operation of the process according the invention, to the strap coil made of AlMgSi basic material is heated by passing alternating current (voltage: 0.02 V/turn, intensity: 5000 A) through the strip by electrodes engaging the ends thereof; after having heated the coil to 750° C and after a holding time of 3 minutes the coil is cooled in the open air.

The essence of the invention lies in heating strap coils made of metal, preferably aluminum and aluminum alloys, by passing direct or alternating current of low turn-voltage and high intensity is led through electrodes into the coils to be subjected to heat treatment, the amplitudes of the voltage and current always depending on the insulation resistance of the insulation layer between the single turns. The current streaming through the strap coil heats the strap to be treated over its entire cross-section.

BRIEF DESCRIPTION OF THE DRAWING

The apparatus for carrying out the process according to the invention is described in detail below referring to the diagrammatic drawing.

SPECIFIC DESCRIPTION

To the strap coil 1, on the surface of which there is a layer of oxide and lubricant and due to the formation of the coil, between the surfaces of the individual turns an air gap has been formed, is connected through electrodes 2 and the interposed current regulator 4 an electrical network. The apparatus supplies the heating current of direct or alternating voltage, needed for the heat treatment of the strap coil 1, with a current intensity which is regulated in dependence of the variation of the electrical resistance during heat treatment; owing to its construction, the apparatus is able to provide a heating current of high intensity and can be connected to the coil in an easy way.

When subjecting a considerable quantity of products to heat treatment, savings in energy is also significant.

Using the process and apparatus according to the invention, mechanical properties of the products treated become homogeneous, compared to known processes the deviation from a standard the is less, duration of heat treatment can be considerably shortened, resulting partly in an increased productivity in a more advantageous material structure and a better surface quality.

What we claim is:

1. A process for heat treating a metal such as aluminum or an aluminum alloy which comprises the steps of:

forming a coil having a plurality of turns from a strip of said metal with the turns being insulated from one another by lubricant layers and oxide layers on the surfaces of the strip and by an air gap formed during coiling of the strip;

applying a voltage across said strip in the coiled state thereof between electrodes connected to the ends of the strip of substantially 0.01 to 0.25 volts per turn and passing a current through said strip of the coil with an intensity of substantially 1,000 to 10,000 amperes, thereby heating the strip of said coil to a temperature between 150° C and 800° C, the intensity of said current being a function of the combined resistance of said layers and said gap;

maintaining the strip of said coil heated by the passage of said current therethrough at said temperature for a period of time; and thereafter cooling said coil.

2. The process defined in claim 1 wherein said temperature is about 750° C and said current intensity is about 5000 amperes.

* * * * *